US011618660B2

(12) United States Patent
Howe

(10) Patent No.: US 11,618,660 B2
(45) Date of Patent: Apr. 4, 2023

(54) EXTENDABLE MAST SYSTEMS AND METHODS FOR A MATERIAL HANDLING VEHICLE

(71) Applicant: The Raymond Corporation, Greene, NY (US)

(72) Inventor: David B. Howe, Binghamton, NY (US)

(73) Assignee: The Raymond Corporation, Greene, NY (US)

( * ) Notice: Subject to any disclaimer, the term of this patent is extended or adjusted under 35 U.S.C. 154(b) by 289 days.

(21) Appl. No.: 16/876,413

(22) Filed: May 18, 2020

(65) Prior Publication Data

US 2020/0277173 A1 Sep. 3, 2020

Related U.S. Application Data

(62) Division of application No. 15/941,649, filed on Mar. 30, 2018, now Pat. No. 10,662,047.

(60) Provisional application No. 62/478,989, filed on Mar. 30, 2017.

(51) Int. Cl.
*B66F 9/08* (2006.01)

(52) U.S. Cl.
CPC ..... *B66F 9/08* (2013.01)

(58) Field of Classification Search
CPC ..... B66F 9/08
See application file for complete search history.

(56) References Cited

U.S. PATENT DOCUMENTS 2,399,632 A * 5/1946 Guerin ..... B66F 9/08 187/234
2,936,047 A * 5/1960 Quayle ..... B66F 9/08 187/229
2,973,835 A * 3/1961 Quayle ..... B66F 9/08 187/229
3,083,853 A * 4/1963 Hastings, Jr. ..... B66F 9/08 414/629

(Continued)

FOREIGN PATENT DOCUMENTS

CN 201385999 Y 1/2010
CN 105050936 A 11/2015

(Continued)

OTHER PUBLICATIONS

European Patent Office, Extended European Search Report, Application No. 18165372.6, dated Sep. 3, 2018, 6 pages.

*Primary Examiner* — Michael A Riegelman
(74) *Attorney, Agent, or Firm* — Quarles & Brady LLP

(57) ABSTRACT

Extendable mast systems and methods for a material handling vehicle include a base mast having a first web connecting a first web first flange and a first web second flange; a base mast bearing; a base mast bumper; a vertically extendable mast having a second web connecting a second web first flange and a second web second flange; and a vertically extendable mast bearing. The base mast bearing is spaced apart from the second web first flange defining a base mast bearing space between the base mast bearing and the second web first flange. The vertically extendable mast bearing is spaced apart from the first web first flange defining a vertically extendable mast bearing space between the vertically extendable mast bearing and the first web first flange. And the base mast bumper maintains the base mast bearing space between the base mast bearing and the second web first flange.

21 Claims, 8 Drawing Sheets

(56) References Cited

U.S. PATENT DOCUMENTS 3,148,005 A * 9/1964 Pusztay ..... B66F 9/08 384/49
3,365,253 A * 1/1968 Haller ..... F16C 33/6651 384/44
3,556,247 A * 1/1971 Akibumi ..... B66F 9/08 187/226
3,638,761 A * 2/1972 Ohta ..... B66F 9/08 187/230
3,851,732 A * 12/1974 Wagner ..... B66F 9/08 187/226
3,871,494 A * 3/1975 Kelly, Jr. ..... B66F 9/08 187/230
4,035,040 A * 7/1977 Yarris ..... F16C 23/082 384/495
4,124,104 A * 11/1978 Yarris ..... B66F 9/12 187/238
4,155,428 A * 5/1979 Hansen ..... B66F 9/08 187/230
4,234,057 A * 11/1980 Nakane ..... B66F 9/08 187/238
4,375,247 A * 3/1983 McNeely ..... F16C 23/08 187/238
4,505,635 A * 3/1985 Shinoda ..... B66F 9/122 414/667
4,614,253 A * 9/1986 Furukawa ..... B66F 9/08 187/230
4,703,834 A * 11/1987 Knappe ..... B66F 9/08 414/631
4,709,786 A * 12/1987 David ..... B66F 9/10 187/226
5,046,585 A * 9/1991 Ohta ..... B66F 9/08 187/226
5,984,050 A * 11/1999 Ronald ..... B66F 9/08 187/234
6,505,710 B1 * 1/2003 Kato ..... B66F 9/08 187/230
8,714,311 B2 * 5/2014 Billger ..... B66F 9/087 187/230
8,851,825 B2 10/2014 Kuck et al.
10,662,047 B2 * 5/2020 Howe ..... B66F 9/08
2003/0057027 A1 * 3/2003 Simpson ..... B66F 9/08 187/230
2006/0027094 A1 * 2/2006 Schonauer ..... B66F 9/22 92/170.1
2013/0146396 A1 * 6/2013 Miwa ..... F16C 29/02 187/230
2015/0075913 A1 * 3/2015 Simpson ..... B66F 9/08 187/230
2016/0244309 A1 * 8/2016 Meloch ..... B66F 9/08
2016/0257541 A1 * 9/2016 Chan ..... B66F 9/08
2016/0272475 A1 * 9/2016 Sakatani ..... B66F 9/08
2017/0167536 A1 * 6/2017 Nordenhem ..... B66F 9/10
2018/0155170 A1 * 6/2018 Nagel ..... B66F 9/16
2018/0282140 A1 * 10/2018 Howe ..... B66F 9/08
2020/0277173 A1 * 9/2020 Howe ..... B66F 9/08

FOREIGN PATENT DOCUMENTS

CN 105217543 A 1/2016
GB 1319660 6/1973

* cited by examiner

EXTENDABLE MAST SYSTEMS AND METHODS FOR A MATERIAL HANDLING VEHICLE

CROSS-REFERENCES TO RELATED APPLICATIONS

This application is a divisional of U.S. patent application Ser. No. 15/941,649 filed Mar. 30, 2018, which is based on, claims priority to, and incorporates herein by reference in its entirety, U.S. Provisional Patent Application No. 62/478,989 filed Mar. 30, 2017, and entitled "Extendable Mast Systems and Methods for a Material Handling Vehicle."

STATEMENT REGARDING FEDERALLY SPONSORED RESEARCH

Not Applicable.

BACKGROUND

The present invention relates to material handling vehicles and, more specifically, to extendable mast systems and methods for material handling vehicles.

Vertically extendable mast assemblies are useful on material handling vehicles for the transportation and placement of loads at varying heights. The mast assemblies can include two or more masts, each mast having two flanges and a web. Vertically extendable mast assemblies typically employ a roller bearing arrangement that facilitates vertical translation of an extendable mast with respect to an already extended mast or a fixed base. In some cases, the bearing can be angularly positioned (canted bearing) such that the bearing contacts the web and one of the flanges that acts as the load bearing flange. Canted bearings are used to help accommodate for variations in parallelism in the vertically extendable mast sections.

A torsional load can be placed on the extendable mast or the fixed base that is caused by twisting or tolerance variations in the structure of at least one of the fixed base or extendable mast. The torsional load may cause variations in position and angle of the first and second flange of the fixed base or extendable mast. Variations in position and angle of the first and second flange may be greatest between a bottom end and a top end of the fixed base or extendable mast when the mast assembly is in a vertically extended arrangement.

A roller bearing can be used for each mast telescopic interface, and the roller bearing is typically intended to ride on only one flange. At times, there may be little or no clearance between the roller bearing and an opposing, non-load bearing flange. The rotation of the roller bearing is driven through contact with the mast. As the roller bearing is forced to move away from the load bearing flange due to the torsional load, it continues to rotate in the same direction. Once the clearance to the opposite flange is taken up, the roller bearing continues to rotate in the same direction, and can contact the non-load bearing flange.

What is needed is systems and methods to improve extendable masts that account for a torsional load.

SUMMARY OF THE INVENTION

The aforementioned shortcomings can be overcome by providing a material handling vehicle with an extendable mast assembly according to the detailed description.

According to one aspect, an extendable mast assembly for a material handling vehicle is provided, the extendable mast assembly comprising a base mast having a first web connecting a first web first flange and a first web second flange; a base mast bearing coupled to the base mast; a base mast bumper coupled to the base mast; a vertically extendable mast having a second web connecting a second web first flange and a second web second flange; a vertically extendable mast bearing coupled to the vertically extendable mast; wherein the base mast bearing is in contact with at least one of the second web second flange and the second web, and the base mast bearing is spaced apart from the second web first flange defining a base mast bearing space between the base mast bearing and the second web first flange; wherein the vertically extendable mast bearing is in contact with at least one of the first web second flange and the first web, and the vertically extendable mast bearing is spaced apart from the first web first flange defining a vertically extendable mast bearing space between the vertically extendable mast bearing and the first web first flange; and wherein the base mast bumper maintains the base mast bearing space between the base mast bearing and the second web first flange.

In some aspects, the extendable mast assembly can also include a vertically extendable mast bumper coupled to the vertically extendable mast; wherein the vertically extendable mast bumper is spaced apart from the first web first flange defining a vertically extendable mast bumper space between the vertically extendable mast bumper and the first web first flange, the vertically extendable mast bearing space being larger than the vertically extendable mast bumper space; and wherein the vertically extendable mast bumper maintains the vertically extendable mast bearing space between the vertically extendable mast bearing and the first web first flange.

In some aspects, the base mast bearing is canted and base mast bumper is parallel to the first web.

In some aspects, the vertically extendable mast bearing is canted and vertically extendable mast bumper is parallel to the second web.

In some aspects, contact between the base mast bumper and second web first flange prevents contact between the base mast bearing and the second web first flange.

In some aspects, contact between the vertically extendable mast bumper and the first web first flange prevents contact between the vertically extendable mast bearing and the first web first flange.

In some aspects, the base mast bearing contacts a load-bearing flange of the material handling vehicle and the base mast bumper is spaced apart from a non-load-bearing flange, the base mast bumper to counteract a twist of the extendable mast assembly.

In some aspects, the vertically extendable mast bearing contacts a load-bearing flange of the material handling vehicle and the vertically extendable mast bumper is spaced apart from a non-load-bearing flange, the base mast bumper to counteract a twist of the extendable mast assembly.

In some aspects, the base mast bearing is fixed to the base mast by a stud that is positioned near a top end of the base mast, and the base mast bumper is fixed to the base mast by a second stud that is positioned near the top end of the base mast.

In some aspects, the vertically extendable mast bearing is fixed to the vertically extendable mast by a stud that is positioned near a bottom end of the vertically extendable mast, and the vertically extendable mast bumper is fixed to the vertically extendable mast by a second stud that is positioned near the bottom end of the vertically extendable mast.

In some aspects, the base mast bearing rotates in a first direction and the base mast bumper rotates in a second direction opposite the first direction.

In some aspects, the vertically extendable mast bearing rotates in a first direction and the vertically extendable mast bumper rotates in a second direction opposite the first direction.

In some aspects, contact between the base mast bumper and the second web first flange maintains the base mast bearing space between the base mast bearing and the second web first flange.

In some aspects, contact between the vertically extendable mast bumper and the first web first flange maintains the vertically extendable mast bearing space between the vertically extendable mast bearing and the first web first flange.

In some aspects, at least one of the base mast bumper and the vertically extendable mast bumper is adjustable.

According to additional aspects, an extendable mast assembly for a material handling vehicle is provided. The extendable mast assembly comprises a base mast having a first web connecting a first web first flange and a first web second flange; a base mast bearing coupled to the base mast; a base mast bumper coupled to the base mast; a vertically extendable mast having a second web connecting a second web first flange and a second web second flange; a vertically extendable mast bearing coupled to the vertically extendable mast; a vertically extendable mast bumper coupled to the vertically extendable mast; wherein the base mast bearing is in contact with at least one of the second web second flange and the second web, and the base mast bearing is spaced apart from the second web first flange defining a base mast bearing space between the base mast bearing and the second web first flange, and the base mast bumper is spaced apart from the second web first flange defining a base mast bumper space between the base mast bumper and the second web first flange, the base mast bearing space being larger than the base mast bumper space; wherein the vertically extendable mast bearing is in contact with at least one of the first web second flange and the first web, and the vertically extendable mast bearing is spaced apart from the first web first flange defining a vertically extendable mast bearing space between the vertically extendable mast bearing and the first web first flange, and the vertically extendable mast bumper is spaced apart from the first web first flange defining a vertically extendable mast bumper space between the vertically extendable mast bumper and the first web first flange, the vertically extendable mast bearing space being larger than the vertically extendable mast bumper space; and wherein the base mast bumper maintains the base mast bearing space between the base mast bearing and the second web first flange, and the vertically extendable mast bumper maintains the vertically extendable mast bearing space between the vertically extendable mast bearing and the first web first flange.

In some aspects, the extendable mast assembly comprises an additional vertically extendable mast having a third web connecting a third web first flange and a third web second flange; an additional vertically extendable mast bearing coupled to the additional vertically extendable mast; an additional vertically extendable mast bumper coupled to the additional vertically extendable mast; wherein the additional vertically extendable mast bearing is in contact with at least one of the second web second flange and the second web, and the additional vertically extendable mast bearing is spaced apart from the second web first flange defining an additional vertically extendable mast bearing space between the additional vertically extendable mast bearing and the second web first flange, and the additional vertically extendable mast bumper is spaced apart from the second web first flange defining an additional vertically extendable mast bumper space between the additional vertically extendable mast bumper and the second web first flange, the additional vertically extendable mast bearing space being larger than the additional vertically extendable mast bumper space; and wherein the additional vertically extendable mast bumper maintains the additional vertically extendable mast bearing space between the additional vertically extendable mast bearing and the second web first flange.

In some aspects, the vertically extendable mast extends vertically, and vertical extension of the vertically extendable mast causes the base mast bearing to rotate, and the rotation of the base mast bearing is driven by the contact between the base mast bearing and the at least one of the second web second flange and the second web.

In some aspects, the extendable mast assembly comprises a second vertically extendable mast bearing coupled to the vertically extendable mast; a second vertically extendable mast bumper coupled to the vertically extendable mast; wherein the second vertically extendable mast bearing is in contact with at least one of the third web second flange and the third web, and the second vertically extendable mast bearing is spaced apart from the third web first flange defining a second vertically extendable mast bearing space between the second vertically extendable mast bearing and the third web first flange, and the second vertically extendable mast bumper is spaced apart from the third web first flange defining a second vertically extendable mast bumper space between the second vertically extendable mast bumper and the third web first flange, the second vertically extendable mast bearing space being larger than the second vertically extendable mast bumper space; and wherein the second vertically extendable mast bumper maintains the second vertically extendable mast bearing space between the second vertically extendable mast bearing and the third web first flange.

In some aspects, the additional vertically extendable mast bearing and the additional vertically extendable mast bumper are connected near the bottom of the third web.

According to additional aspects, a method is provided. The method comprises providing a base mast having a first web connecting a first web first flange and a first web second flange; providing a base mast bearing coupled to the base mast; providing a base mast bumper coupled to the base mast; providing a vertically extendable mast having a second web connecting a second web first flange and a second web second flange; providing a vertically extendable mast bearing coupled to the vertically extendable mast; wherein the base mast bearing is in contact with at least one of the second web second flange and the second web, and the base mast bearing is spaced apart from the second web first flange defining a base mast bearing space between the base mast bearing and the second web first flange, and the base mast bumper is spaced apart from the second web first flange defining a base mast bumper space between the base mast bumper and the second web first flange, the base mast bearing space being larger than the base mast bumper space; wherein the vertically extendable mast bearing is in contact with at least one of the first web second flange and the first web, and the vertically extendable mast bearing is spaced apart from the first web first flange defining a vertically extendable mast bearing space between the vertically extendable mast bearing and the first web first flange; and the base mast bumper maintaining the base mast bearing space between the base mast bearing and the second web first flange.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION OF THE INVENTION

Figure 1:
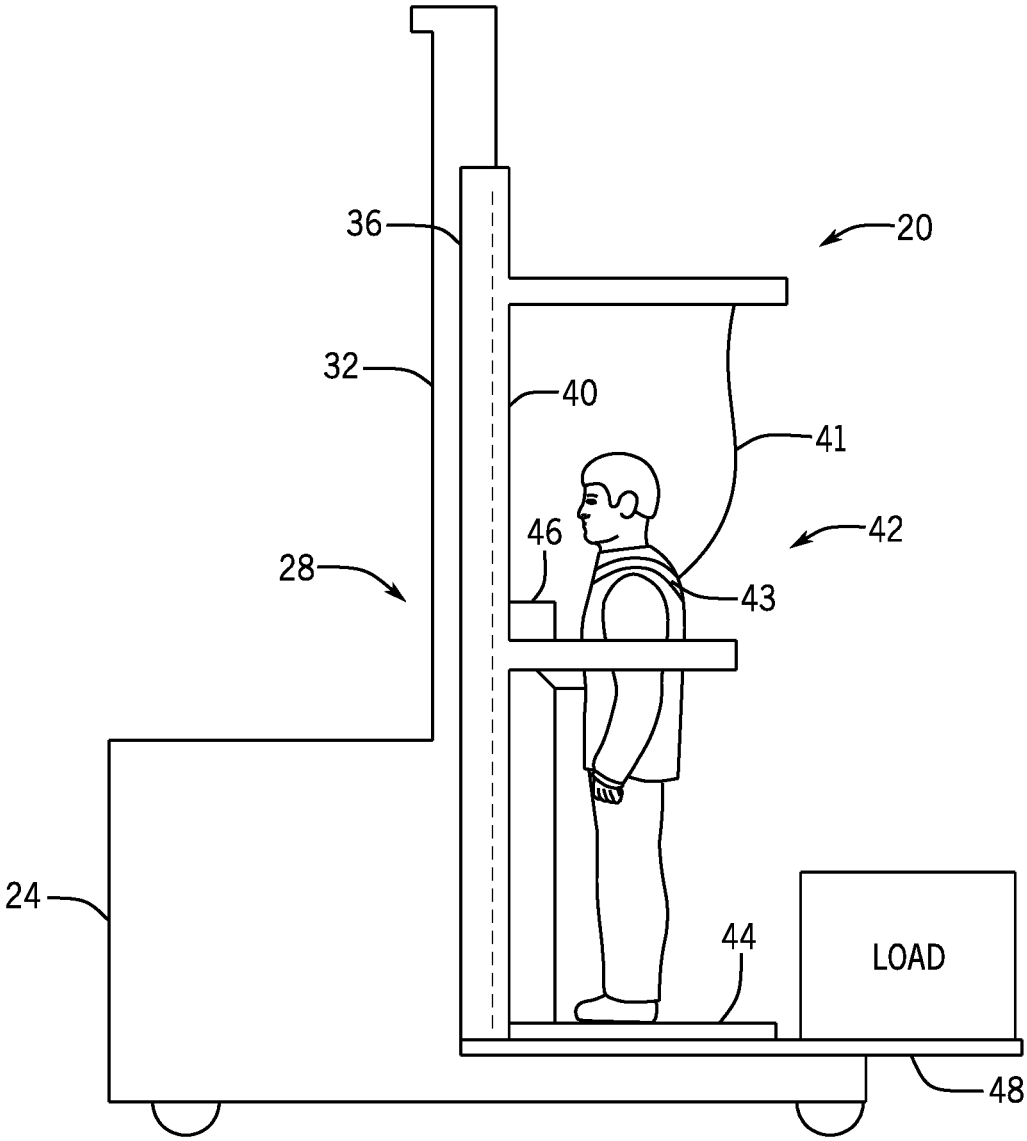
FIG. 1 is a side view of an exemplary material handling vehicle.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

It is to be appreciated that material handling vehicles are designed in a variety of configurations to perform a variety of tasks. Although the material handling vehicle described herein is shown by way of example as an order picker, it will be apparent to those of skill in the art that the present invention is not limited to vehicles of this type, and can also be provided in various other types of material handling vehicle configurations, including for example, reach trucks, SWING-REACH® lift trucks, and any other lift vehicles. The various configurations are suitable for both driver controlled, pedestrian controlled and remotely controlled material handling vehicles.

Figure 2:
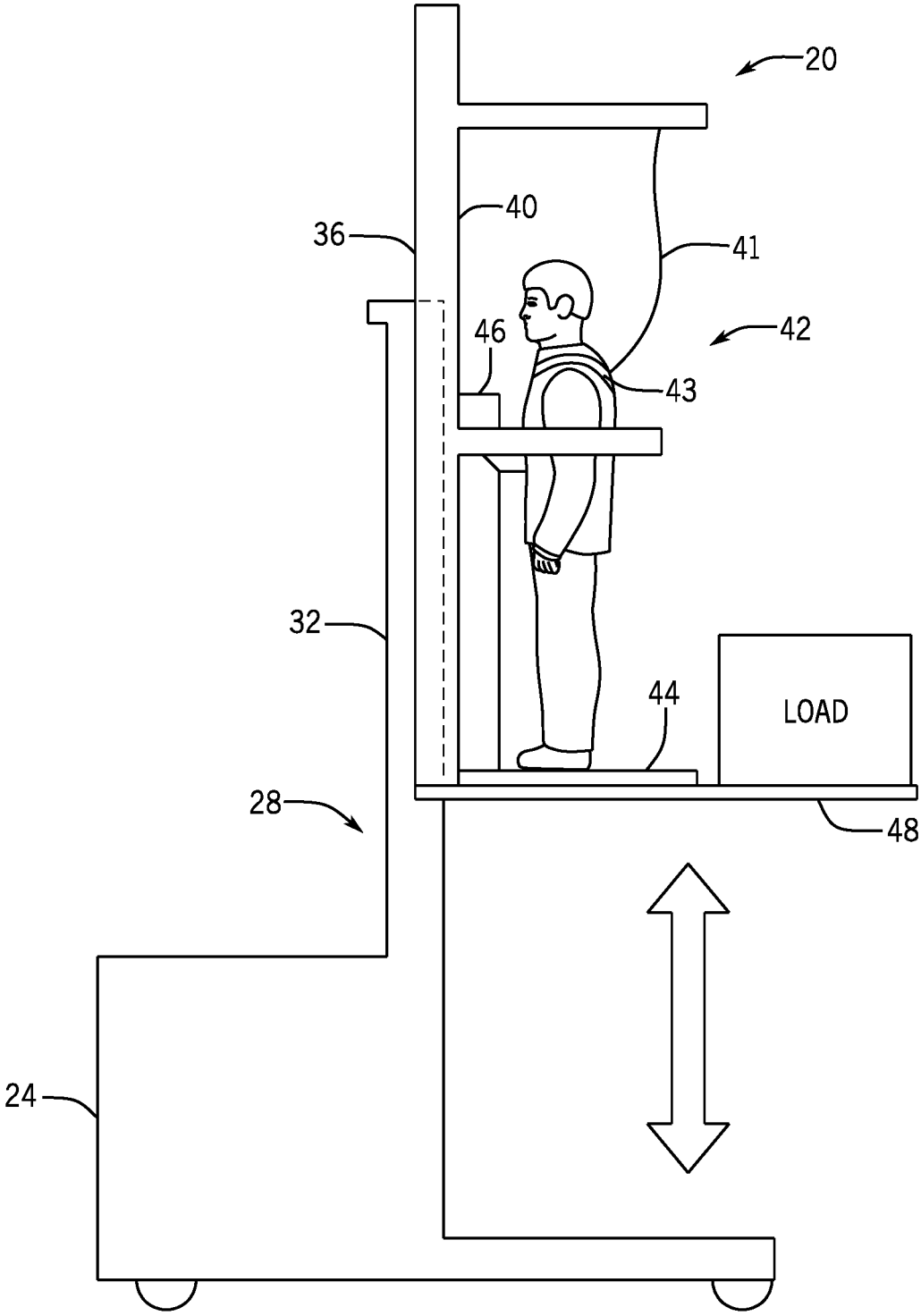
FIG. 2 is a side view of an exemplary material handling vehicle in a vertically extended position.

Referring now to the Figures, and more particularly to FIGS. 1 and 2, the general arrangement of a representative material handling vehicle 20 is shown. FIG. 1 shows the material handling vehicle 20 in a neutral or down position and FIG. 2 shows the material handling vehicle 20 in a vertically extended position. The material handling vehicle 20 includes a tractor unit 24, and a vertically extendable mast 28 mounted relative to the tractor unit 24. The vertically extendable mast 28 includes a fixed base 32 and an extendable mast section 36, which can have a vertically movable platform 40 attached to the extendable mast section 36. The extendable mast section 36 raises and lowers the platform 40. In some aspects, multiple extendable mast sections can be included in the vertically extendable mast.

In one embodiment of the material handling vehicle 20, the platform 40 includes an operator station or compartment 42. The operator compartment 42 includes an operator platform 44, and an operator console 46 for operation of the material handling vehicle 20, including operation of the platform 40 functions. An operator harness 43 and tether 41 is also shown. The operator console 46 includes controls (not shown) for controlling material handling vehicle steering and speed, and includes controls for controlling raising and lowering the platform 40, and operation of platform forks 48. The operator compartment 42 may also include lights, and one or more displays for displaying operational data. It is to be appreciated that alternative embodiments of the material handling vehicle 20 may include a fixed operator compartment on the tractor unit 24 (i.e., the operator does not travel up and down with the platform), or may not include a designated operator compartment, such as when the operator does not stand on the material handling vehicle 20, but walks along with the material handling vehicle 20 and controls the material handling vehicle 20 using a control handle (not shown).

Figure 3:
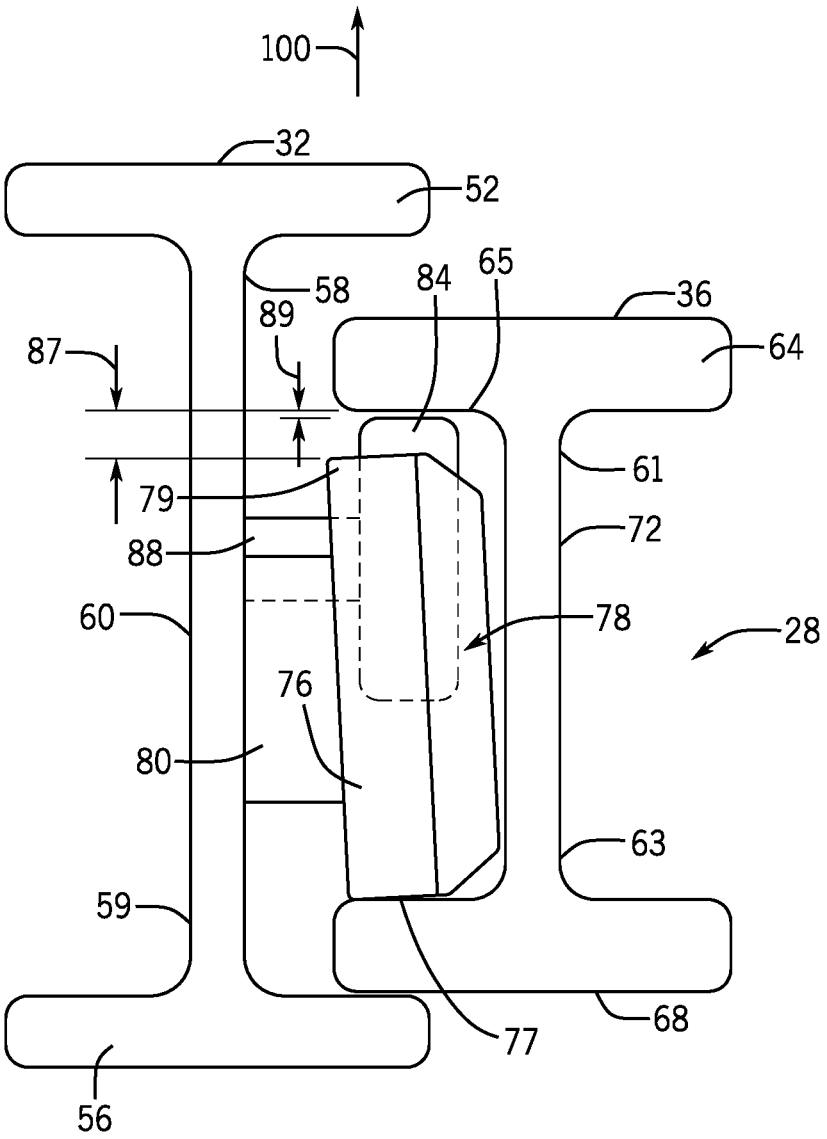
FIG. 3 is a top view of an extendable mast assembly for a material handling vehicle.

FIGS. 3-9 show non-limiting embodiments of the extendable mast 28. The fixed base 32 can have a first flange 52 and a second flange 56 connected by a web 60. The first flange 52 and the second flange 56 can extend perpendicularly outward on from opposite ends 58, 59 of the web 60. The arrangement of the first flange 52, second flange 56, and web 60 can create an I-beam shape or C beam shaped, i.e., with flat sides, where the web 60 can be longer than the first flange 52 and the second flange 56. The extendable mast section 36 can include a first flange 64 and a second flange 68 connected by a web 72. The first flange 64 and the second flange 68 can extend perpendicularly outward from opposite ends 61, 63 of the web 72. Similar to the fixed base 32, the arrangement of the first flange 64, second flange 68, and web 72 can create an I-beam shape or C beam shaped with flat sides where the web 72 can be longer than the first flange 64 and the second flange 68, as seen in FIG. 3. In some embodiments, the fixed base 32 may be offset with respect to the position of the extendable mast section 36 such that the second flange 56 of the fixed base 32 can be received between the first flange 64 and second flange 68 of the extendable mast section 36. In some embodiments, the web 60 of the fixed base 32 may be generally parallel with the web 72 of the extendable mast section 36.

Figure 4:
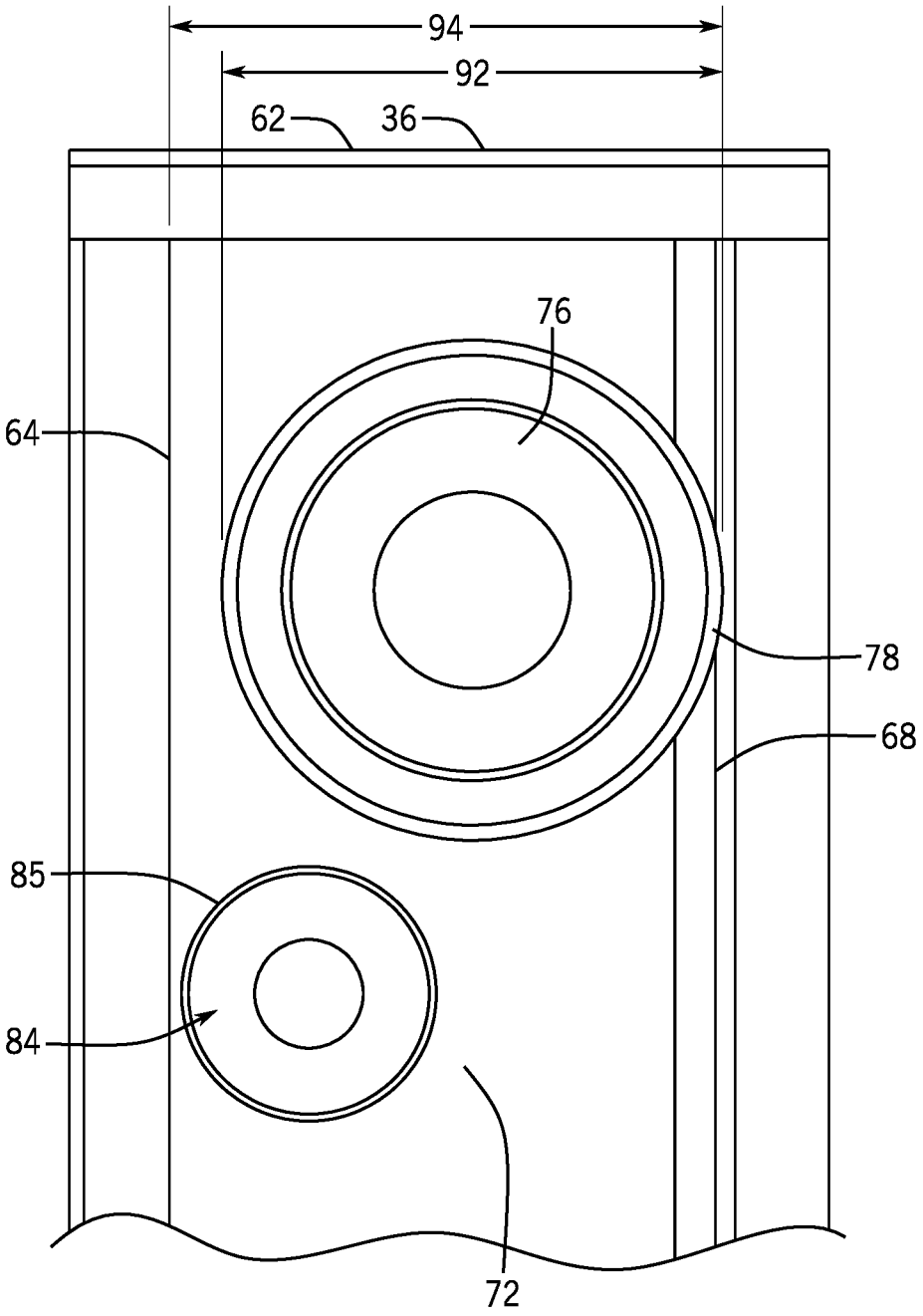
FIG. 4 is a side view of an extendable mast assembly for a material handling vehicle.

A first bearing 76 can be connected to the first web 60 near a top end 62 of the fixed base 32 via stud 80, and may be received between the first flange 64 and second flange 68 of the extendable mast section 36. The first bearing 76 may be generally cylindrical in shape and may have an outer diameter that is greater than an outer diameter of the stud 80. The first bearing 76 may have a tapered end 78 on the side of the first bearing 76 that interfaces with the extendable mast section 36 that tapers inward, which may create a tapered surface around the circumference of the tapered end 78 that can lead to a smaller diameter of the first bearing 76 on a surface of the bearing that can interface with the extendable mast section 36. The first bearing 76 may be positioned at an angle with respect to the web 60 of the fixed base 32 such that the first bearing 76 is canted and an end 77 of the first bearing 76 nearest the second flange 68 of the extendable mast section 36 extends away from the fixed base 32 further than an opposing end 79 of the first bearing 76. In some embodiments, the first bearing 76 can contact the web 72 at a location near the second flange 68 due to the angled position of the first bearing 76, and a circumferential outer surface of the first bearing 76 may contact an inner surface of the second flange 68. As shown in FIG. 4, the first bearing 76 can have a diameter 92, the diameter 92 being less than a distance 94 between the inner surface 65 of the first flange 64 and the inner surface of the second flange 68. A bumper 84 may be coupled to the web 60 in order to maintain a separation between the first bearing 76 and the first flange 64.

Figure 5:
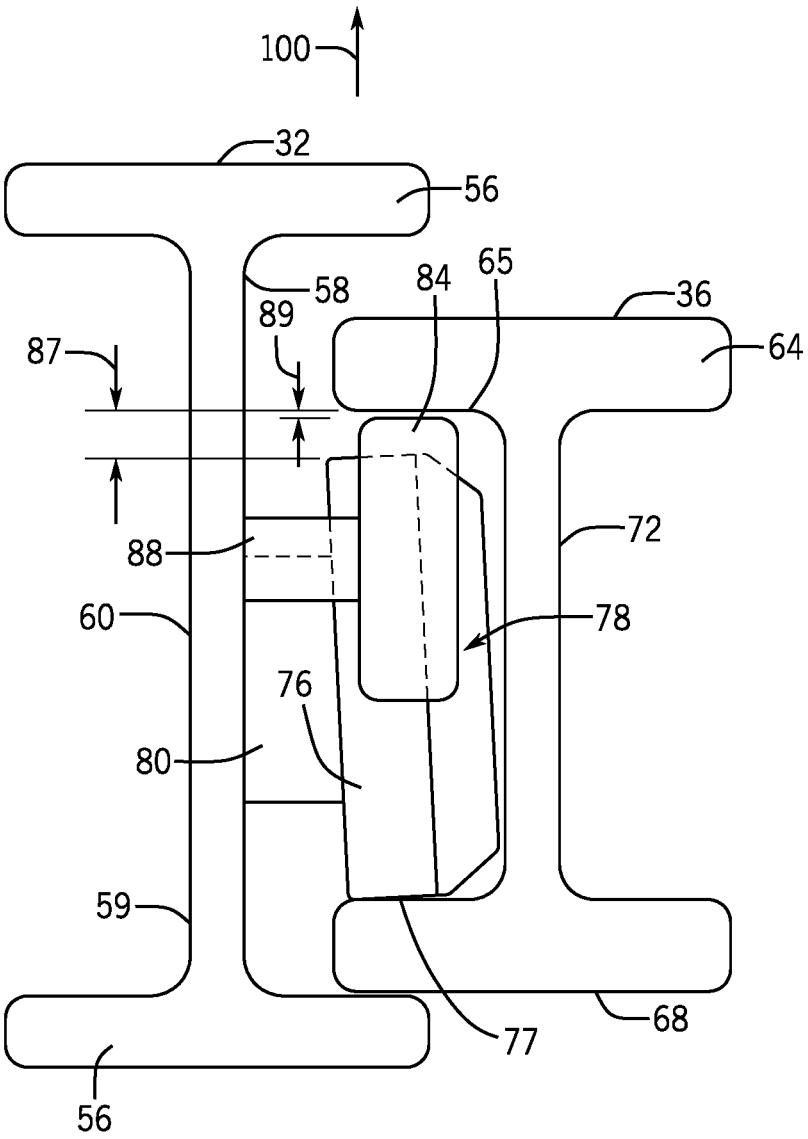
FIG. 5 is a bottom view of an extendable mast assembly for a material handling vehicle.

The bumper 84 may be generally cylindrical in shape and may be positioned above or below the first bearing 76. The bumper 84 can be coupled to the web 60 near the top end 62 of the fixed base 32 via a stud 88, for example, as seen in FIGS. 3, 4 and 5, and can rotate. The positioning of the bumper 84 can be adjustable. The bumper 84 may be received between the first flange 64 and the second flange 68 of the extendable mast section 36. In some embodiments, the bumper 84 may have an outer diameter that is smaller than the outer diameter of the first bearing 76. In some embodiments, the bumper 84 may be positioned such that it is generally parallel with the web 60 of the fixed base 32 and the web 72 of the extendable mast section 36. A circumferential outer surface 85 of the bumper 84 may contact an inner surface 65 of the first flange 64 of the extendable mast section 36 when a torsional load is applied to the extendable mast section 36. Contact between the bumper 84 and the inner surface 65 of the first flange 64 may provide a predefined bearing space 87 (see FIG. 3) between the first bearing 76 and the inner surface 65 of the first flange 64 such that the first flange 64 and the first bearing 76 remain spaced apart. A bumper space 89 may be positioned between the bumper 84 and the inner surface 65 of the first flange 64 in order to provide tolerance for variation in the extendable mast section 36 or fixed base 32 while preventing contact between the first bearing 76 and the inner surface 65 of the first flange 64. The positioning of the bumper 84 can be adjusted to adjust the bumper space 89. As seen in FIG. 3, predefined bearing space 87 is larger than the bumper space 89 to cause the bumper 84 to contact the first flange 64 before the first bearing 76 can contact the first flange 64. The bearing space 87 can be reduced when twisting occurs in the web, and the bumper 84 is positioned to maintain the first bearing 76 at least spaced apart from the first flange 64.

The bumper 84 can be non-load-bearing such that the bumper 84 does not carry the load from the platform forks 48. Rather, the bumper 84 is placed to maintain a separation between the first flange 64 and the first bearing 76. In some aspects, the bumper 84 may be a roller that can rotate about the stud 88, which can reduce friction within the extendable mast assembly. In other aspects, the bumper 84 can take any appropriate shape, for example, the bumper 84 can be a polymer slide or a block of steel integral with or coupled to the web 60. In either case, the bumper 84 as the polymer slide, block of steel, or any other shape or form of material, is placed to provide the first flange 64 and the first bearing 76 remain spaced apart, particularly when twisting occurs in a web due to a torsional load, as described in more detail below.

The extendable mast section 36 can translate vertically with respect to the fixed base 32, and the translation of the extendable mast section 36 may be guided by the rotational motion of the first bearing 76 and the bumper 84. Vertical translation of the extendable mast section 36 may cause the first bearing 76 to rotate, the rotation may be driven by the contact between the web 60 and the outwardly angled end of the first bearing 76 near the second flange 68. Vertical translation of the extendable mast section 36 may cause the bumper 84 to rotate, the rotation may be driven by the contact between the circumferential outer surface 85 of the bumper 84 and the first flange 64 of the extendable mast section 36. The circumferential outer surface of the bumper 84 may contact the inner surface 65 of the first flange 64 to maintain the predefined bearing space 87 between the first bearing 76 and the inner surface 65 of the first flange 64 such that the first flange 64 and the first bearing 76 remain spaced apart when any twisting may occur in the extendable mast section 36 or the fixed base 32 that would otherwise cause the first bearing 76 to contact the first flange 64.

The first bearing 76 may rotate in a first direction while the bumper 84 may rotate in a second direction that is opposite to the first direction. In some embodiments, while the vertically extendable mast 28 is being extended, the first bearing 76 may rotate clockwise while the bumper 84 may rotate counterclockwise. In other embodiments the first bearing 76 may rotate counterclockwise while the bumper 84 may rotate clockwise. The first bearing 76 and the bumper 84 may rotate in different directions due to the first bearing 76 being in contact with the web 72 and the second flange 68 and the bumper 84 being in contact with the inner surface 65 of the first flange 64.

The torsional load placed on the extendable mast section 36 or the fixed base 32 may be caused by twisting or tolerance variations in the structure of at least one of the fixed base 32 or extendable mast section 36. The twisting or tolerance variation may cause variations in position and angle of the first flange 52, 64 and second flange 56, 68 of the fixed base 32 or extendable mast section 36. In some embodiments, variations in position and angle of the first flange 52, 64 and second flange 56, 68 may be greatest at the top end 62 of the fixed base 32 or between a bottom end 81 and a top end 83 of the extendable mast section 36 when the vertically extendable mast 28 is in a vertically extended arrangement. The variations between the top end 81 and the bottom end 83 can be counteracted by the contact between the bumper 84 and the inner surface 65 of the first flange 64 because the contact maintains the predefined bearing space 87 between the first bearing 76 and the first flange 64, which allows the first bearing 76 to rotate with movement of the extendable mast section 36. The outer diameter of bumper 84 can be small enough such that the bumper does not contact the second flange 68, which allows the bumper 84 to rotate freely with the vertical translation of the first flange 64. The addition of the bumper 84 along with its contact with the first flange 64 maintains space between the first bearing 76 and the first flange 64.

In some embodiments, the bumper 84 can be mounted in a similar manner to the first bearing 76, e.g., a stud 80, and may be welded or bolted to the web, for example. This could be incorporated into existing mast designs. In other embodiments, the first bearing 76 and the bumper 84 may be mounted on an integrated stud since the relationship between the first bearing 76 and the bumper 84 can be consistent.

Figure 6:
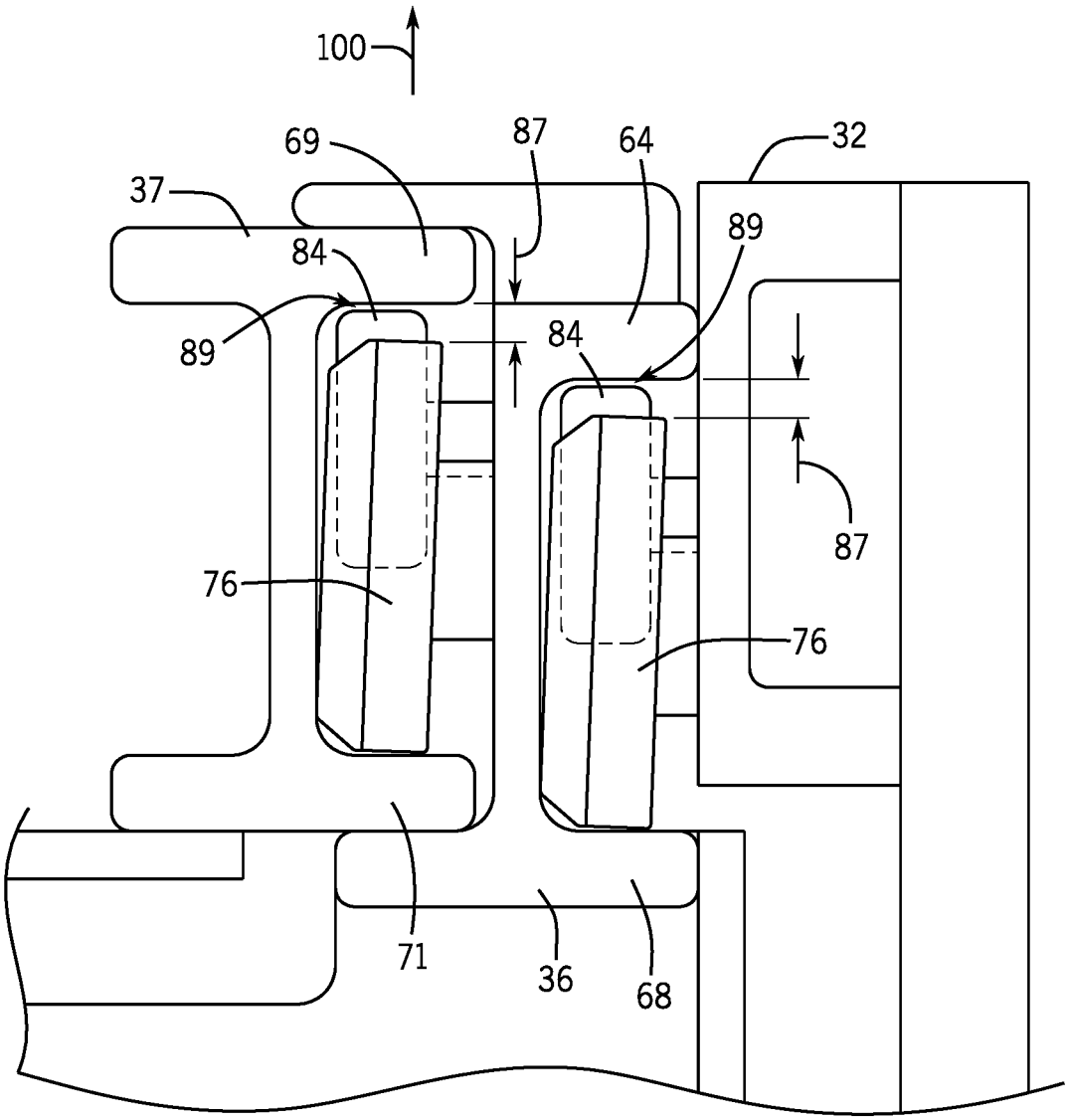
FIG. 6 is a top view of a non-limiting example of a vertically extendable mast assembly for a material handling vehicle.

FIG. 6 shows a non-limiting example of a vertically extendable mast of a material handling vehicle that utilizes the first bearing 76 and the bumper 84 in order to provide a predefined space between the first bearing 76 and the inner surface 65 of first flange 64 such that the first flange 64 and the first bearing 76 remain spaced apart. The fork side or load direction of the material handing vehicle is indicated by element 100.

Figure 7:
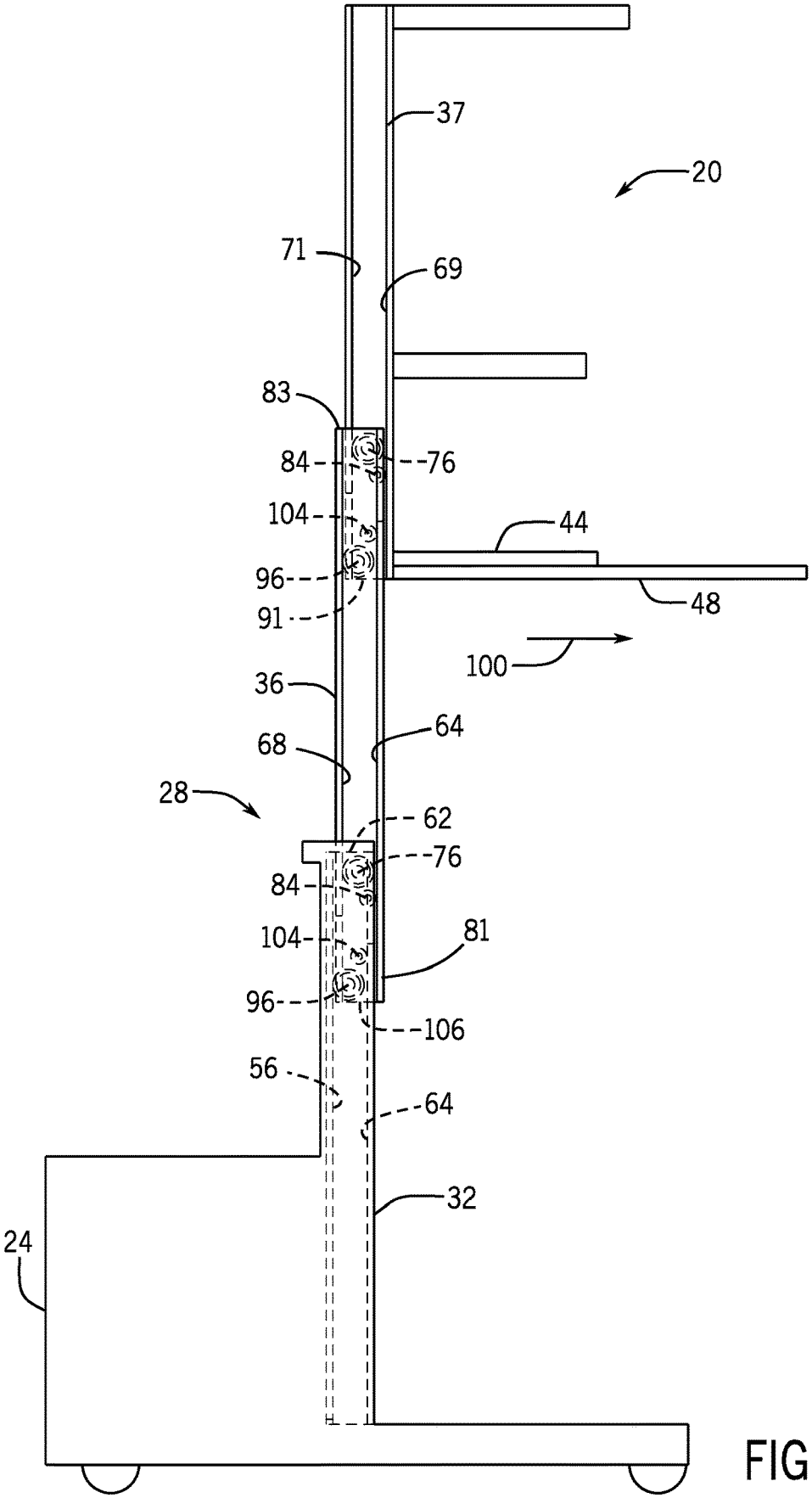
FIG. 7 is a side view of a non-limiting example of a vertically extendable mast assembly for a material handling vehicle.
Figure 8:
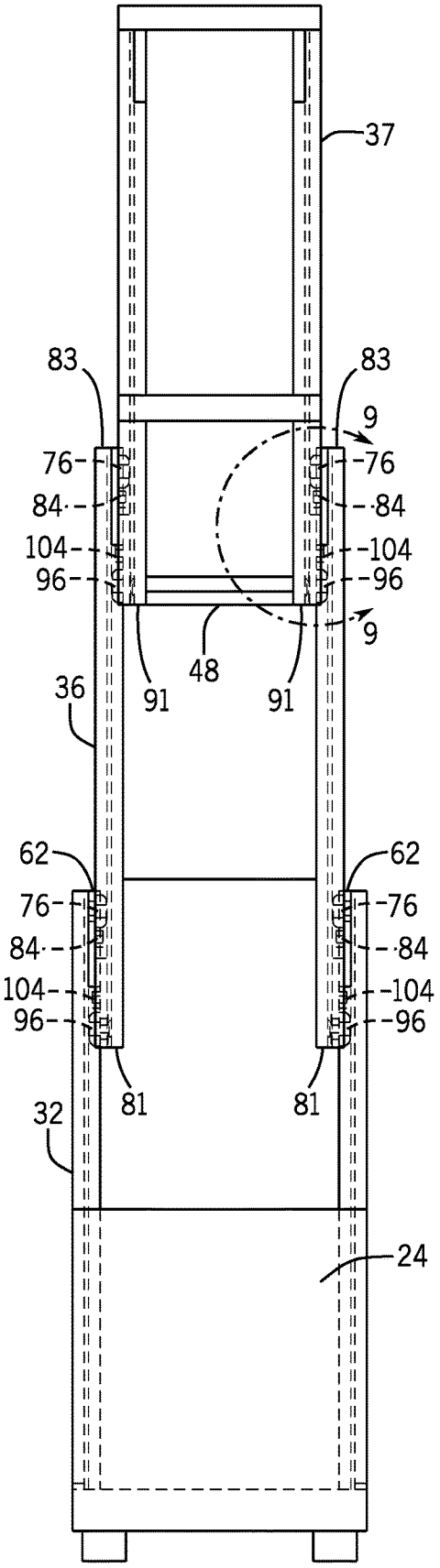
FIG. 8 is a front view of a non-limiting example of a vertically extendable mast assembly for a material handling vehicle.
Figure 9:
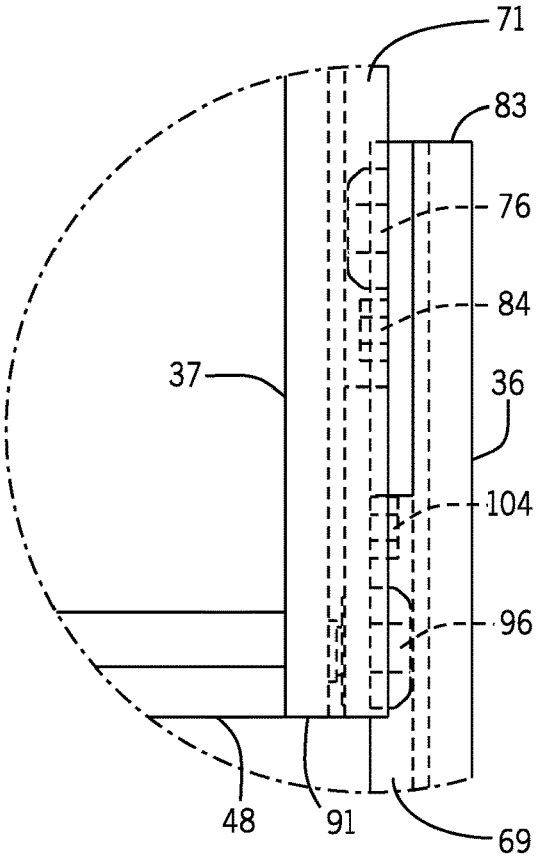
FIG. 9 is a close-up view of the section 9-9 of FIG. 8.

FIGS. 7-9 show a non-limiting example of the representative material handling vehicle 20 in a vertically-extended position having the extendable mast section 36 and the additional extendable mast section 37 having a first flange 69 and a second flange 71 in combination with the fixed base 32. The fixed base 32 has the first bearing 76 and the bumper 84 connected to the fixed base 32 and positioned near the top end 62 of the fixed base 32. The bumper 84 is positioned on the load direction 100 side of the vehicle and the first bearing 76 is positioned opposite the load direction 100 side of the vehicle. A first bearing 96 and a bumper 104 are shown connected near a bottom end 106 of the extendable mast section 36. The first bearing 96 can be positioned below the bumper 104 and each can be connected near the bottom end 106 of the extendable mast section 36. The bumper 104 can be positioned on the load direction 100 side of the vehicle and the first bearing 96 is positioned opposite the load direction 100 side of the vehicle.

As discussed above, twisting or tolerance variation may cause variations in position and angle of the first flange 52, 64 and second flange 56, 68 of the fixed base 32 or extendable mast sections 36 and 37. In some embodiments, variations in position and angle of the first flange 52, 64 and second flange 56, 68 may be greatest between a bottom end 81 and a top end 83 of the extendable mast section 36 when the vertically extendable mast 28 is in a vertically extended arrangement. The variations between the top end 83 and the bottom end 81 can be counteracted by the contact between the bumper 104 and the inner surface 65 of the first flange 64 because the contact maintains space between the first bearing 96 and the first flange 64, which allows the first bearing 96 to rotate or slide with movement of the extendable mast section. The outer diameter of bumper 104 can be small enough such that the bumper does not contact the second flange 68, which allows the bumper 104 to rotate freely with the vertical translation of the first flange 64. The addition of the bumper 104 along with its contact with the first flange 64 maintains bearing space 87 between the first bearing 96 and the first flange 64.

Having the first bearing 76 and the bumper 84 at the top of the extendable mast 36 and the first bearing 96 and the bumper 104 at the bottom of the extendable mast 36 maintains the first bearing 76 and the first bearing 96 to remain in contact with the second flange 56, 68 of the fixed base 32 or extendable mast section 36. The first bearing 76 and the first bearing 96 remain in contact with the second flange 56, 68 of the fixed base 32 or extendable mast section 36 respectively despite the torsional loads described above as the variations in position and angle can occur at either the bottom end 81 or the top end 83 or both ends 81, 83 of the extendable mast 36, and the variations in position and angle may not be equal on both ends 81, 83.

FIGS. 8 and 9 show the first bearing 76 and the bumper 84 positioned near the top end 62 of the fixed base 32 (may be referred to as the base mast bearing and base mast bumper) and may be positioned facing inward on the extendable mast assembly 28 such that the first bearing 76 and the bumper 84 are received by the extendable mast 36. The first bearing 96 and the bumper 104 are positioned near the bottom end 81 of the extendable mast 36 (may be referred to as the extendable mast bearing and extendable mast bumper) and positioned facing outward on the extendable mast assembly 28 such that the first bearing 96 and the bumper 104 are received by the fixed base 32. The first bearing 76 and the bumper 84 positioned near the top end 83 of the extendable mast 36 (may be referred to as the second extendable mast bearing and second extendable mast bumper) and positioned facing inward on the extendable mast assembly 28 such that the first bearing 76 and the bumper 84 are received by the additional extendable mast section 37. The first bearing 96 and the bumper 104 are positioned near a bottom end 91 of the additional extendable mast section 37 (may be referred to as the additional extendable mast bearing and additional extendable mast bumper) and positioned facing outward on the extendable mast assembly 28 such that the first bearing 96 and the bumper 104 are received by the extendable mast 36.

Within this specification embodiments have been described in a way which enables a clear and concise specification to be written, but it is intended and will be appreciated that embodiments may be variously combined or separated without parting from the invention. For example, it will be appreciated that all features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

I claim:

1. A method for reducing the effect of a torsional load on a material handling vehicle having an extendable mast, the method comprising:

extending a mast section relative to a fixed base, the extendable mast including the mast section and the fixed base;

contacting a first bearing with the mast section, the first bearing being coupled to the fixed base;

providing a bumper, the bumper being coupled to the fixed base; and contacting the bumper with the mast section to prevent contact between the first bearing and a portion of the mast section.

2. The method of claim 1, wherein the mast section has a first flange, and an opposite second flange, further comprising:

creating a bearing space defined between the first flange of the mast section and the first bearing; and creating a bumper space defined between the first flange of the mast section and the bumper, the bumper space being smaller than the bearing space.

3. The method of claim 2, further comprising adjusting the bumper space.

4. The method of claim 2, further comprising preventing contact between the first flange of the mast section and the bumper.

5. The method of claim 4, wherein a diameter of the bumper is configured to prevent the contact between the second flange of the mast section and the bumper.

6. The method of claim 2, wherein a load direction defined by a position of the fork of the material handling vehicle is directed through the first flange and the second flange.

7. The method of claim 1, wherein the bumper is configured to rotate, and further comprising:

rotating the first bearing in a first direction; and rotating the bumper in a second direction, the first direction being opposite the second direction.

8. The method of claim 1, wherein the mast section includes a fork, and wherein the mast section is torsionally loaded when a load is placed on the fork, and further comprising the bumper counteracting a twist of the mast section caused by the torsionally loaded fork.

9. The method of claim 8, wherein the bumper does not carry the load placed on the fork.

10. The method of claim 1, further comprising angling the first bearing.

11. A method for reducing the effect of a torsional load on a material handling vehicle having an extendable mast, the method comprising:

creating a bearing space defined between a flange of the extendable mast and a bearing coupled to the extendable mast;

creating a bumper space defined between the flange of the extendable mast and a bumper coupled to the extendable mast; and the bumper preventing contact between the flange of the extendable mast and the bearing.

12. The method of claim 11, further comprising contacting the flange of the extendable mast with the bumper for preventing the contact between the flange of the extendable mast and the bearing.

13. The method of claim 11, wherein the extendable mast includes:

a fixed base;

a first mast section movably attached to the fixed base; and a second mast section, and wherein the bumper and the bearing are coupled to at least one of the fixed base, the first mast section, and the second mast section.

14. The method of claim 13, wherein the bearing space is a first bearing space, and wherein the bumper space is a first bumper space, and the method further comprising:

creating a second bearing space defined between another flange of the extendable mast and a second bearing coupled to the extendable mast; and creating a second bumper space defined between the another flange of the extendable mast and a second bumper coupled to the extendable mast, and the second bumper preventing contact between the another flange of the extendable mast and the second bearing.

15. The method of claim 14, wherein the flange is a second flange, the another flange is a fourth flange, and further comprising:

extending the first mast section relative to the fixed base;

contacting the first bearing with a second flange of the extendable mast; and contacting the first bumper with a first flange of extendable mast.

16. The method of claim 15, further comprising:

extending the second mast section relative to the first mast section;

contacting the second bearing with a third flange of the extendable mast; and contacting the second bumper with the fourth flange of the extendable mast.

17. The method of claim 14, wherein the flange is a second flange, and wherein the another flange is a fourth flange, wherein the fixed base has a first flange and the second flange, wherein the first mast section has a third flange and the fourth flange, wherein the first bearing and the first bumper are coupled to the fixed base, and wherein the second bearing and the second bumper are coupled to the first mast section.

18. The method of claim 17, wherein the first bearing and the first bumper are positioned above the second bearing and the second bumper.

19. The method of claim 14, wherein the flange is a first flange, and wherein the another flange is a third flange, wherein the first mast section has the first flange and a second flange, wherein the second mast section has the third flange and a fourth flange, wherein the first bearing and the first bumper are coupled to the first mast section, and wherein the second bearing and the second bumper are coupled to the second mast section.

20. A method for maintaining a predefined space on a mast of a material handling vehicle, the mast including a base mast and a vertically extendable mast, the base mast including a first web connecting a first web first flange and a first web second flange, the base mast including a base mast bearing and a base mast bumper coupled to the base mast, the vertically extendable mast including a second web connecting a second web first flange and a second web second flange, the vertically extendable mast including a vertically extendable mast bearing coupled to the vertically extendable mast, the method comprising:

extending the vertically extendable mast relative to the base mast, such that the base mast bearing is contacting at least one of the second web second flange and the second web, and the base mast bearing is spaced apart from the second web first flange by the predefined space, the predefined space being a space between the base mast bearing and the second web first flange, and the vertically extendable mast bearing is contacting at least one of the first web second flange and the first web, and the vertically extendable mast bearing is spaced apart from the first web first flange defining a vertically extendable mast bearing space between the vertically extendable mast bearing and the first web first flange; and maintaining the predefined space such that the base mast bumper is maintaining the space between the base mast bearing and the second web first flange.

21. A method comprising:

providing a base mast having a first web connecting a first web first flange and a first web second flange;

providing a base mast bearing coupled to the base mast;

providing a base mast bumper coupled to the base mast;

providing a vertically extendable mast having a second web connecting a second web first flange and a second web second flange;

providing a vertically extendable mast bearing coupled to the vertically extendable mast;

wherein the base mast bearing is in contact with at least one of the second web second flange and the second web, and the base mast bearing is spaced apart from the second web first flange defining a base mast bearing space between the base mast bearing and the second web first flange, and the base mast bumper is spaced apart from the second web first flange defining a base mast bumper space between the base mast bumper and the second web first flange, the base mast bearing space being larger than the base mast bumper space;

wherein the vertically extendable mast bearing is in contact with at least one of the first web second flange and the first web, and the vertically extendable mast bearing is spaced apart from the first web first flange defining a vertically extendable mast bearing space between the vertically extendable mast bearing and the first web first flange; and the base mast bumper maintaining the base mast bearing space between the base mast bearing and the second web first flange.

* * * * *